United States Patent [19]

Clark

[11] Patent Number: 4,685,623

[45] Date of Patent: Aug. 11, 1987

[54] METHOD AND APPARATUS FOR TREATING PULP

[76] Inventor: James d'A. Clark, 300 Hot Springs Rd., Santa Barbara, Calif. 93108

[21] Appl. No.: 726,966

[22] Filed: Apr. 29, 1985

Related U.S. Application Data

[63] Continuation-in-part of Ser. No. 426,620, Sep. 29, 1982, abandoned.

[51] Int. Cl.[4] ..... B02C 19/12

[52] U.S. Cl. ..... 241/21; 241/28; 241/111

[58] Field of Search ..... 162/18, 28, 56, 358, 162/261; 241/28, 56, 26, 21, 28, 251, 260, 261, 259.1, 259.2, 111, 259.3, 112, 117, 120, 121, 122, 252, 254, 242; 29/121.6

[56] References Cited

U.S. PATENT DOCUMENTS

| | | | |
|---|---|---|---|
| 221,992 | 11/1879 | Allen | 241/28 X |
| 1,552,098 | 9/1925 | Wagner | 29/121.6 |
| 1,891,165 | 12/1932 | Knupffer | 241/111 |
| 2,055,956 | 9/1936 | Wells | 241/111 |
| 2,092,628 | 9/1937 | Allen | 241/111 X |
| 2,909,334 | 10/1959 | Nilsson et al. | 241/28 X |
| 3,198,694 | 8/1965 | Justus | 162/358 |

OTHER PUBLICATIONS

Laboratory Kollergang, pp. 331 and 333.

TAPPI Publication, T225-OS-75, entitled "Laboratory Processing of Pulp (Kollergang Method), 12-1975.

*Primary Examiner*—Mark Rosenbaum

*Attorney, Agent, or Firm*—Dirk J. Veneman; Raymond W. Campbell; David J. Archer

[57] ABSTRACT

A method and apparatus is disclosed for treating pulp prior to being made into paper, which treatment is known as beating or refining. The method comprises feeding a slurry of the pulp to the narrow nips of grooved rolls at which the slurry of pulp is partially dewatered then almost simultaneously fragments of the pulp are subjected to a predetermined heavy pressure, then dispersed before being subjected to the same sequence until treated to the desired degree.

1 Claim, 11 Drawing Figures

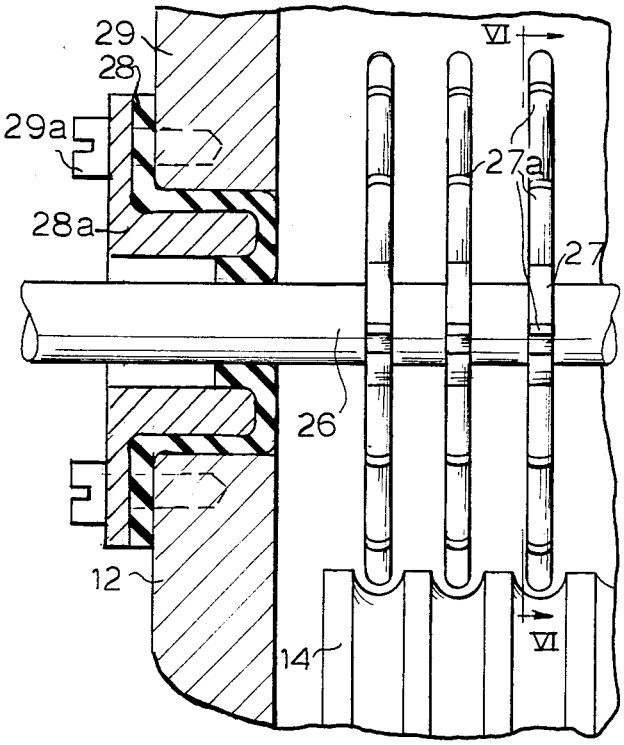
FIG. 5
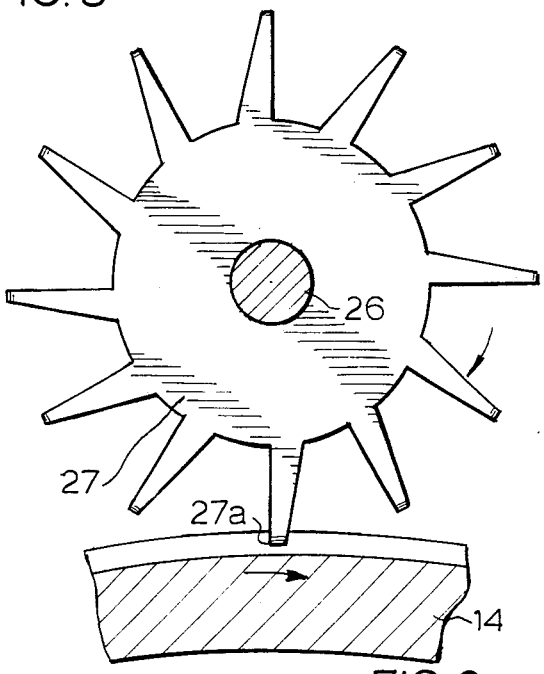
FIG. 6
FIG. 8
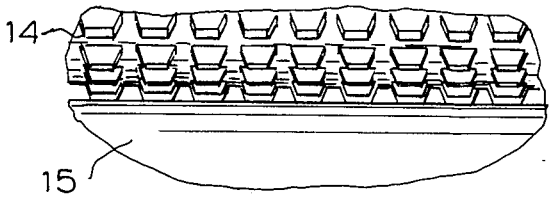
FIG. 7
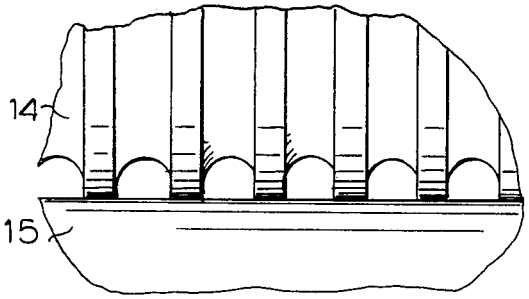
FIG. 9
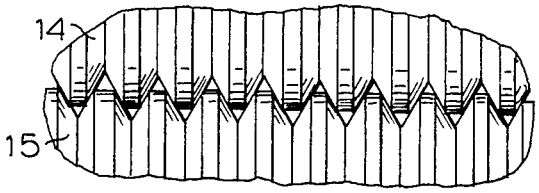
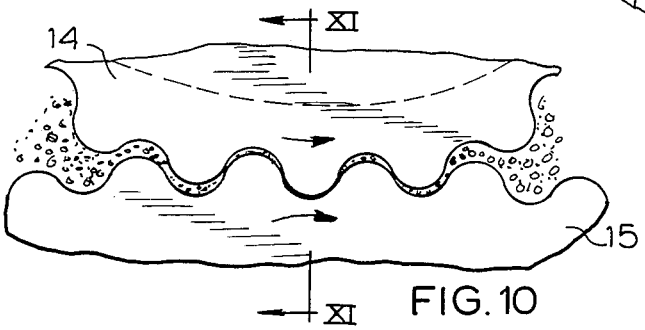
FIG. 10
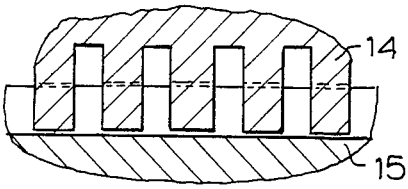
FIG. 11

METHOD AND APPARATUS FOR TREATING PULP

This is a continuation-in-part, of application Ser. No. 426,620 filed Sept. 29, 1982 now abandoned.

BACKGROUND OF THE INVENTION

Before pulp is formed into paper, it is almost invariably subjected to mechanical treatment in order to shorten, abrade, and internally fibrillate or bruise the structure of the fibers in the desired proportion and degree. The present method of accomplishing this is to make a slurry of the pulp with a concentration (consistency) of 3% to 5% and crush and rub the mixture between disks fitted with narrow metal bars disposed nearly radially. The relative speed of the bars is usually from 3,000 to 6,000 feet per minute and the pressure between the faces of the bars may be as high as 1,000 p.s.i. Consequently, the operation consumes a very large amount of energy for the resulting disruption of the fibrous structure. It is well recognized that, considering the results, the present method mechanically is a most inefficient operation.

An obvious approach to save energy which has no doubt been tried is to crush a layer of wet fibers between smooth rolls. However, it is not possible to feed any practical amount of wet fibers through such a nip, because water is squeezed from the pulp before it reaches the nip and the expressed water prevents the roll surface from grasping the pulp. Roughening the surfaces is no solution because the roughness would not much improve adhesion because the expressed water would tend to push and float the fibers away. Furthermore, the roughness would cut the fibers unduly, even if satisfactory feeding were possible.

It should be mentioned that with common barred machines, fiber clots are formed on the rapidly moving edges of the bars, which are further dewatered on the edges of the opposing bars when they come into contact. For effective treatment it is necessary that the clots of pulp be dewatered to about 50% dry before mechanical treatment.

Fifty years ago, I designed a laboratory apparatus constructed to beat a small batch of about three ounces of pulp prior to making it into test sheets of paper so as to evaluate its properties. The apparatus comprised three heavy rollers with 9-mm wide rims having 3 mm wide central grooves, the rollers restrained by gearing to rotate within a frame around a smooth, flat circular track around the bottom of a V-shaped annular trough. It and other beating devices have been described in detail by me in my textbook Pulp Technology and Treatment for Paper, pages 331 to 333, published by Miller Freeman in San Francisco in 1978said disclosure being incorporated herein by reference.

Although the described laboratory apparatus was successful and has since been adopted as one of four instruments to carry out one of the official test methods of the Technical Association of the Pulp and Paper Industry (T225 OS-75), its principle of operation was not until recently fully understood; nor was it envisaged how the tiny laboratory batch apparatus could be modified and transformed into a simple, large, commercial machine having a continuous and substantial output of several tons an hour as is now described in the present invention.

OBJECTS OF THE INVENTION

It is an object of the invention to provide a novel method and means for refining paper pulp with the minimum amount of energy.

It is another object to provide a simple means for controlling the intensity of treatment of the pulp.

It is still another object to provide means for emphasizing one or the other of the three basic actions of refining, namely, shortening, abrading, and crushing of the fibers.

These and some of the other objects and advantages of the invention will hereinafter become apparent.

DESCRIPTION OF THE DRAWINGS

FIG. 5 shows a rotating toothed shaft adapted to keep clean the circumferential grooves on a roll;

FIG. 6 is an end view taken through 6—6 of FIG. 5;

FIG. 7 shows a side view of a portion of one form of nip between the grooved center drum and a smooth roll;

FIG. 8 shows the side view of another form of the nip between a smooth roll and the center drum with circumferential and longitudinal grooves;

FIG. 9 shows a side view of a portion of another form of nip between the grooved center drum and a grooved outer roll;

FIG. 10 shows the front view of a portion of the center drum and a roll both longitudinally and circumferentially grooved; and FIG. 11 is a side view of part of FIG. 10 through 1—1.

DETAILED DESCRIPTION

Figure 1:
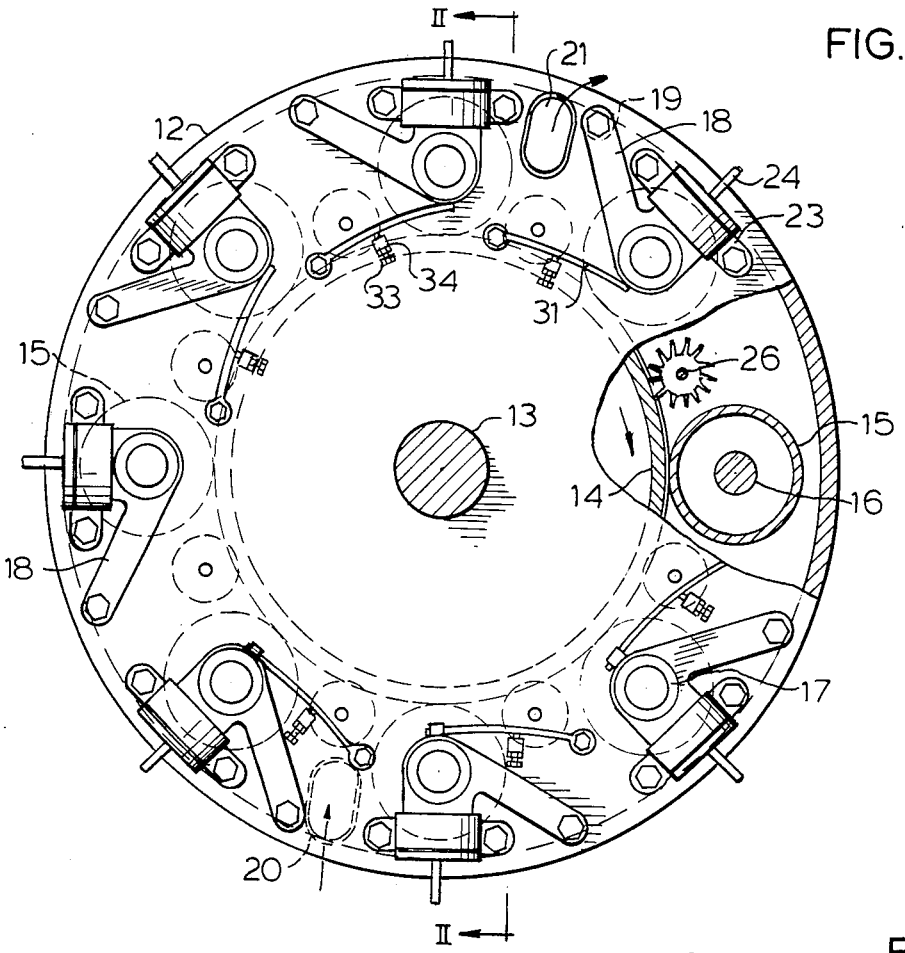
FIG. 1 shows somewhat schematically a front view partially in section of an apparatus embodying the invention through 1—1.
Figure 2:
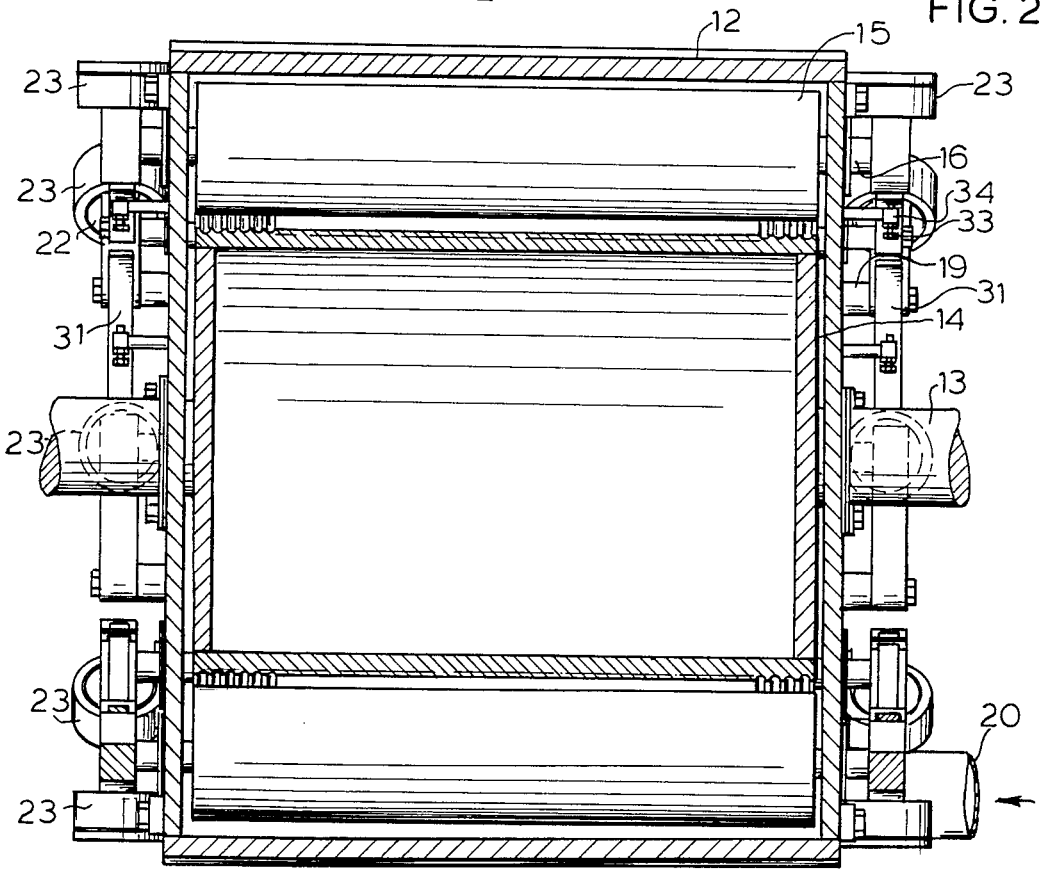
FIG. 2 shows a side view partially in section taken through 2—2 of FIG. 1 of the apparatus.

Basically, the method of treating pulp fibers in accordance with the present invention involves mixing the fibers with sufficient water to form a slurry, directing a continuous stream of the slurry to a series of narrow nips located between a pair of revolving rolls, the widths of the nips being less than that which would cause the slurry carrying a major portion of the fibers to enter the spaces between the sides of the nips as the rolls revolve, and pressing the revolving rolls together with a predetermined force adequate to provide the desired effect on the fibers from the slurry that pass between the nips. The narrow nips have contacts thereon whose widths do not exceed significantly the lengths of the longest fibers in the slurry, so the contacts generally have widths not exceeding about 9 mm and preferably of 3 mm or less.

By so adjusting the relationship between the row of intermittent contacting widths in the nips, they grab and dewater the fibers before crushing them, allowing the water to flow through the spaces between the contacting widths. This action will not happen if the contacts are much wider than the longest fibers in the slurry, because in that case, the individual nips would push the slurry sideways to the openings and not allow them to grab any but a tiny proportion of the fibers.

In the preferred embodiment of the invention there are a large number of contacting elements along the length of the roll, each element preferably having a width of less than three times the average lengths of the fibers in the pulp with channels between the elements of sufficient size to permit passage of the water squeezed from the pulp by adjacent elements. Thus, the spacing between the contacts is insufficient to cause most of the slurry presented to them to be pushed to the openings between the contacts.

Another feature of the present invention involves continuously mechanically dispersing clots of pulp that are compressed in the nips.

In the drawings 12 indicates the outer cylindrical casing of one form of the apparatus of the invention. Mounted on a shaft 13 driven by a motor (not shown) is a circumferentially grooved drum 14. Spaced around the drum are a number of usually plain rolls 15 each of which has a shaft 16, the ends of which pass through holes in the sides of the casing 12 and rotate on bearings 17 which are housed at the ends of lever arms 18 which are pivoted on pins 19 affixed to both sides of the casing. Normally only the grooved drum 14 is driven, the rolls 15 being rotated by friction. However, all the rolls 15 may be geared together and driven separately. In this case, with some paper stocks, it may be desirable to subject the fibers to additional rubbing by arranging for a differential peripheral speed between the drum 14 and the rolls 15.

The casing 12 has an inlet 20 and an outlet 21 (shown schematically by arrowed lines) for the pulp slurry which at the desired consistency is pumped through the apparatus at the desired rate depending on the extent of treatment required.

Figure 3:
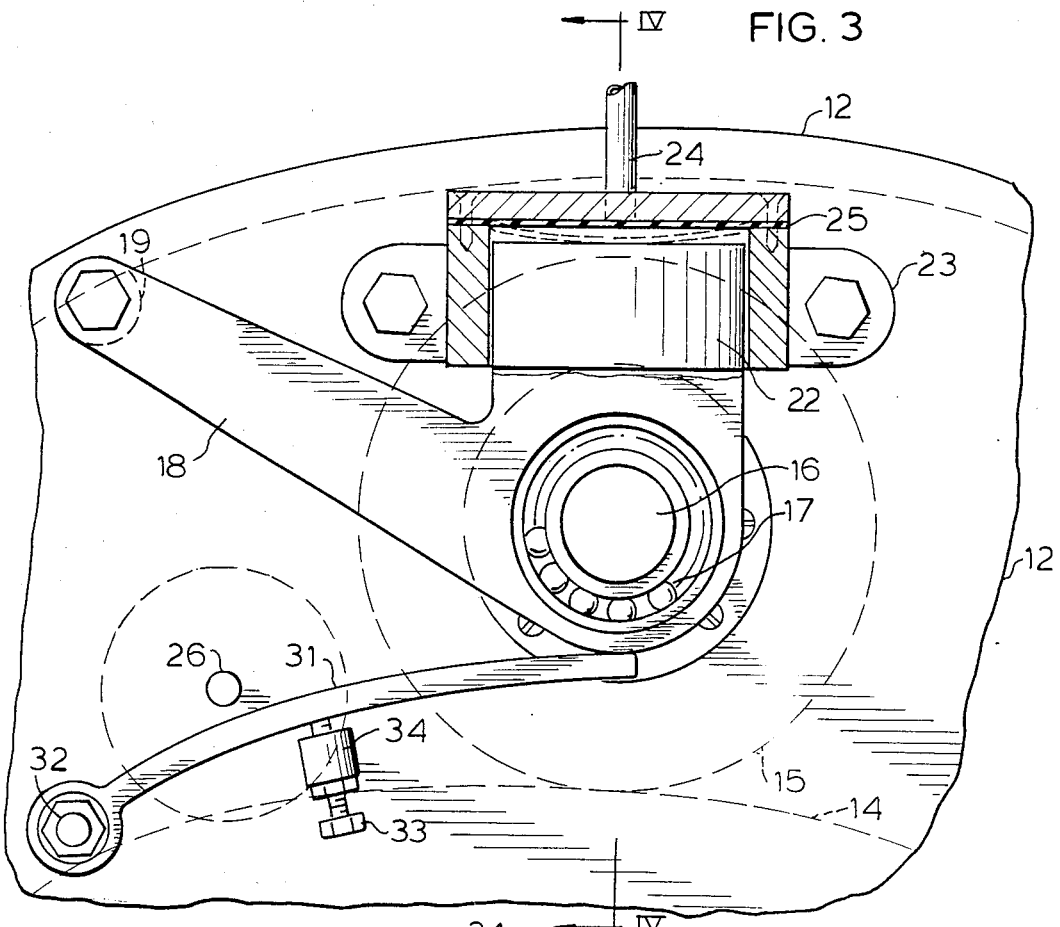
FIG. 3 shows a front section taken through 3—3 of FIG. 4 showing a means of applying pressure to the rolls.

The rolls 15 from both sides are pressed against the driven drum 14 by a circular piston 22, FIG. 3, sliding in a casting 23 which piston is part of the arm 18 and which is activated by fluid pressure supplied through inlets 24 to a rubber diaphragm 25, all of which inlets may be connected to a common fluid pressure source. If the apparatus is not operated in a vertical but in a horizontal position, the arm of each roll is supplied, for example, with a leaf spring 31 held at one end by a stud 32 affixed to one side of the casing 12 and by means of screw 33 turning in pillar 34, caused to balance the weight of rolls 15 if the rolls are situated on the upper part of the casing or if the rolls are on the lower part, to apply upward pressure to arm 18 to support the weight of the rolls. The springs will not be needed for the two rolls in the middle. It will be observed that the movement of the rolls 15 needs to be only very small, enough to provide some flexibility if a large lump of pulp goes through the nip.

Figure 4:
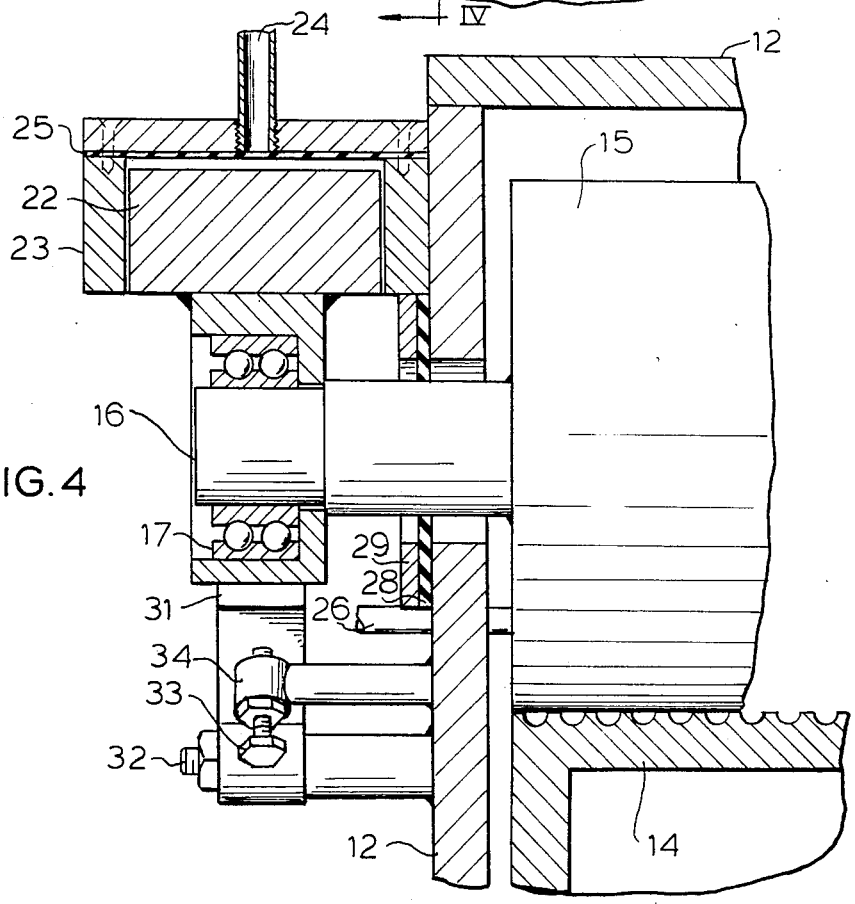
FIG. 4 shows a side section taken through 4—4 of FIG. 3.

Referring to FIGS. 5 and 6 located adjacent to the outgoing sides of each of the nips between all the rolls 15, adjacent the drum 14 is a milled shaft 26 driven by a high speed motor (not shown). The shaft 26 carries spike wheels 27 which have teeth **27*a* milled in the periphery so that the tips sweep through the grooves on drum 14 and keep them clear in case any pulp should plug their grooves. A simple means of preventing leakage through the sides of casing 12 is to have the shaft 26 pass through an opening in a seal 28 which is held in place by a ring 28*a* held by bolts 29*a* against the housing end 29. The seal is made of rubber or suitable sealing material constructed essentially as illustrated for sealing the rotary shaft. A similar construction for shaft 16 is shown in FIG. 4 where the seal is shown simplified for purposes of illustration only as a rubber disk 28 with a shaft opening therethrough and it will be understood that various forms of seals may be employed. The milled shaft 26, FIGS. 5 and 6 and teeth 27*a*** have the additional and desirable function of dispersing clots of pulp that were loosened after being compressed in the nips.

FIG. 7 shows one type of contact between the rolls 15 and the drum 14 which by adjusting the pressure to about 30 pounds per land width of about ⅛ in. and the concentration (consistency) of the pulp to about 3% gives results similar to that of barred apparatus with respect to shortening abrasion and crushing all of which occur to some degree.

It is contemplated that a pattern illustrated in FIG. 8 will enhance the shortening effect if this is desired, and that shown in FIGS. 9 and 10 will enhance the abrading effect. The patterns are not to be presumed restricted to those shown but may assume a number of different forms depending on the type of pulp, the type of paper desired, the consistency of the pulp, the applied pressure between the rolls, and the throughput.

The means of keeping teeth in the rolls 14 and 15 clean and the pulp dispersed in the pattern shown in FIG. 10 and 11 may take the same form as shown in FIGS. 5 and 6, operating in circumferential grooves spaced around the rolls, whereas that shown in FIG. 9 may require the shafts to be situated that the teeth are applied to each roll.

It will be obvious that many modifications to the apparatus may be made without departing from the spirit of the invention which is mainly that of providing a very flexible treatment of pulp for paper with a minimum of energy as compared to existing machines.

I claim as my invention:

1. A method of treating pulp fibers to be made into paper, which comprises the steps of:

mixing the fibers with sufficient water to form a slurry, directing a continuous stream of the slurry to a series of narrow nips defined by a drum and a plurality of revolving rolls, pressing said rolls against the drum with a predetermined pressure, causing the nips to grab a substantial portion of the fibers in the stream, the fibers being longer than the width of each of the nips, permitting the remaining stream of water and uncaught fibers to pass through circumferential grooves disposed between adjacent nips, squeezing the fibers caught between the nips, and dispersing the squeezed fibers into the surrounding slurry upon leaving the nips.

* * * * *